US005120298A

United States Patent [19]

Jäger

[11] Patent Number: 5,120,298

[45] Date of Patent: Jun. 9, 1992

[54] DECANTER WITH A TO-THAT-EXTENT VIBRATION-DISENGAGED ASSEMBLY

[75] Inventor: Ernst A. Jäger, Vilsbiburg, Fed. Rep. of Germany

[73] Assignee: Flottweg GmbH, Vilsbiburg, Fed. Rep. of Germany

[21] Appl. No.: 459,636

[22] Filed: Jan. 2, 1990

[30] Foreign Application Priority Data

Dec. 30, 1988 [DE] Fed. Rep. of Germany ..... 3844406
Dec. 30, 1988 [DE] Fed. Rep. of Germany ..... 3844407

[51] Int. Cl.[5] ..... B04B 1/20; B04B 9/02; B04B 9/14

[52] U.S. Cl. ..... 494/53; 494/82; 494/84

[58] Field of Search ..... 494/53, 52, 82, 83, 494/24, 85, 54, 46, 84, 37

[56] References Cited

U.S. PATENT DOCUMENTS 4,069,966 1/1978 Crosby ..... 494/82
4,421,502 12/1983 Jakobs ..... 494/53

*Primary Examiner*—Robert W. Jenkins
*Attorney, Agent, or Firm*—Max Fogiel

[57] ABSTRACT

A decanter for separating a suspension into a solid space and one or more liquid phases, in which a rotatable drum with a screw inside, rests on a machine bed. The screw is rotatable at a speed that is different from the speed of the drum. A transmission is provided between the drum and the screw, and a motor on the bed is connected to the transmission through a torque-transmitter. Intake and outlet lines communicate with the drum to connect the solids and liquid phases. An elastic bearing disengages at least one of the drum, screw, motor, and transmission in at least one direction having a vector component parallel to the axis of rotation of the decanter. The elastic bearing engages the drum, screw and transmission through the attenuator or damper.

12 Claims, 3 Drawing Sheets

FIG. 1
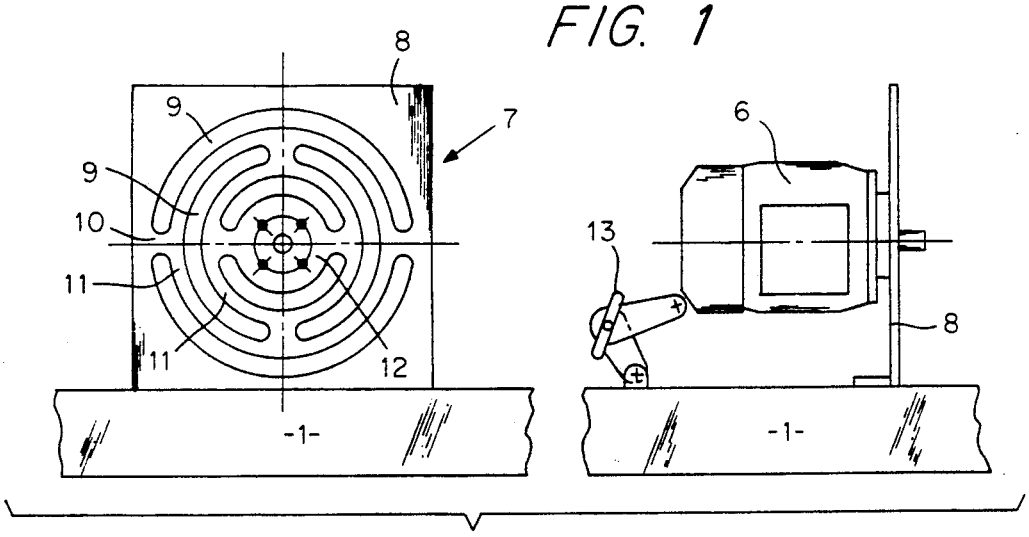
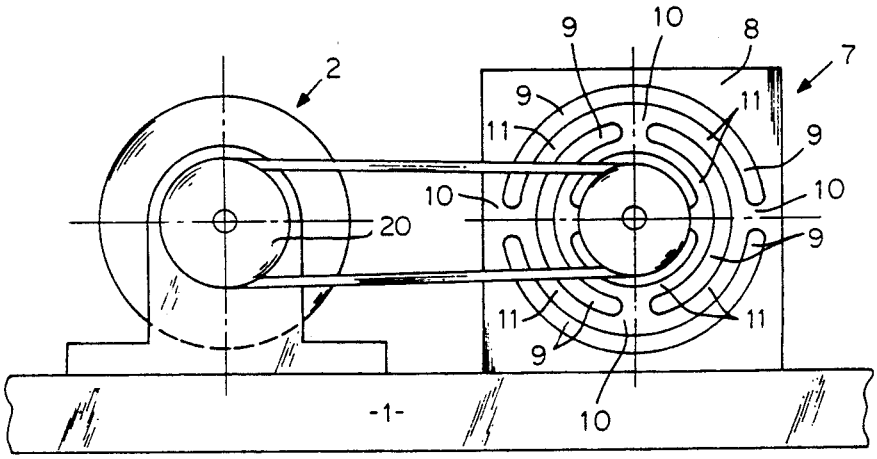
FIG. 2
FIG. 3
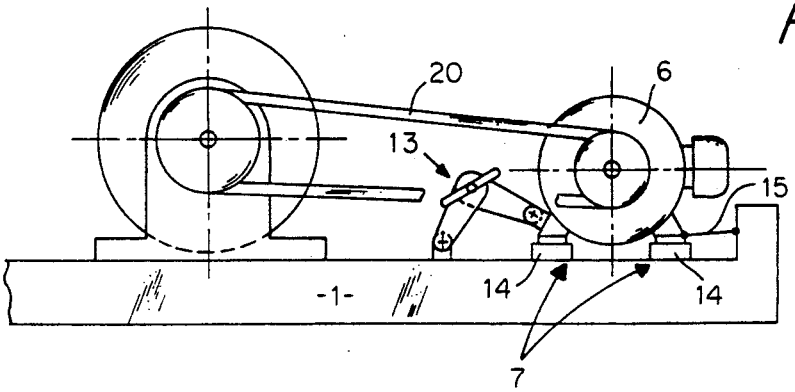

DECANTER WITH A TO-THAT-EXTENT VIBRATION-DISENGAGED ASSEMBLY

BACKGROUND OF THE INVENTION

Decanters, which are also called solid-bowl screw-type centrifuges, are employed to separate what are called suspensions, materials that comprise a mixture of solids and one or more liquids of different weights. Since the suspensions are separated by centrifugal force, high speeds can be necessary. The solids accumulate subject to gravity on the inner surface of the bowl, whence they are conveyed by a screw that rotates relatively slowly inside the rapidly rotating bowl, generally through a dry section that narrows conically up along the axis of rotation to what is called the solids-extraction point, whereas the liquid phase or the several liquid phases of different weights are extracted, generally at the end of the drum that is axially opposite the solids-extraction point, in batches with specific gravities that decrease successively toward the axis. Decanters of this type are known.

A decanter, especially a high-speed decanter, comprises in conjunction with its drive mechanism and sometimes with such accessories as a switchbox etc., all mounted on a joint machine bed, an instrumentation system with at least one critical natural frequency for the decanter's operating behavior that can be one of several natural frequencies in the system. The critical natural frequency, at which the moving parts oscillate with a high amplitude, is disruptive when it is near or below the decanter's operating frequency, which is dictated by the rotating parts: the drum, the screw, the motor, etc. The operating frequency is only theoretically constant and actually represents a particular range, affected even by the amount of solids taken in, by the controls, etc. Also present are vibration phenomena produced by the solids as a function of their connecting the drum to the screw to the extent that friction deriving from the screw that is advancing the solids leads to braking phenomena that express themselves as tension in the differential-speed transmission between the drum and the screw, so that the screw does not remain constant with respect to its differential speed in relation to the drum but is subjected to a particular rhythm in its variation of the speed.

SUMMARY OF THE INVENTION

The object of the present invention is to prevent or attenuate to the greatest extent possible critical natural vibrations in a decanter system of the aforesaid type, a system of masses in other words that are connected by way of the machine bed.

The initial point of departure for the invention accordingly is the concept of keeping the critical natural frequency out of the range of the operating frequencies because the operating frequency has an excitation effect due to balance errors in the drum, screw, etc. In the simplest embodiment this is accomplished just by shifting the mass system to higher values with respect to the critical natural frequency by disengaging some of the mass. Depending on the design or on the mass and elasticity, this measure alone can be enough to settle what is called the critical natural frequency of a system diminished by the disengaged component of mass outside or, more precisely, above the operating-frequency range, so that the threatening critical natural frequency will no longer be excitationally triggered by whatever operating frequency is occurring.

In one especially preferred embodiment, the disengaged portion of the mass, a component that is at any rate present in conjunction with the decanter's operation, is disengaged to the extent that its suspension on the machine bed or on the remaining parts is correspondingly "softer" in relation to the elastic engagement. It will in practice preferably be this resilience with which the modification of the vibrating mass is undertaken, and less preferably the mass of the disengaged part, which, due to its function, can not be modified as desired. What is important is for the disengaged component of mass to be dimensioned in terms of its natural or installation frequency in relation to the machine bed and hence to the remaining components of the mass system or to be matched in terms of its elastic suspension such that its natural frequency equals the critical natural frequency of the remaining mass system. An attenuating structure, which will be activated due to the associated high amplitudes over a correspondingly long friction path and will accordingly absorb energy of vibration in the event that the critical natural frequency occurs, is interposed between the accordingly disengaged component of mass and the remaining mass in the system, particularly in other words between the disengaged mass and the machine bed.

The disengaged mass can in one particularly preferred embodiment be the motor that drives the decanter, with its installation frequency accordingly being within the range of the critical natural frequency of the remaining mass system. The motor is accordingly elastically suspended from the machine bed such that when it receives an impact it will undergo a vibration at a frequency within the range of the critical natural frequency, such that, when the excitation is appropriate and when an accordingly higher amplitude occurs, the attenuating structure between the motor and the machine bed will deliver correspondingly high frictional work.

The latter measure, of course, becomes more and more useful as it become increasingly impossible to shift the critical natural frequency far enough out of the range of operating frequencies that no more malfunctions will occur just by disengaging one (or more) components. Similar considerations also apply of course to critical natural frequencies below the operating frequency that have to be passed through when the decanter is turned on.

The foregoing has employed a mass that can be disengaged from the decanter's motor as an example. It is, however, also possible to similarly disengage accessories or other parts of the decanter and to "synchronize" in relation to the critical natural frequency.

As previously mentioned herein, a disruptive vibration can also occur in operation in addition to the natural frequency occasioned by the mechanical structure of the decanter itself due to the effects of the solids in whatever suspension is being processed. This effect is not constant and does not linearly depend on speed. To eliminate the resulting frequency effects the screw can be intentionally disengaged from the decanter, preferably in the vicinity of the rotary connection between the two parts. The transmission between the screw and the drum can be a rigid transmission, although it can also be a variable transmission motor. The screw can preferably be disengaged from the rotor by way of a friction mechanism in accordance with a principle that is known in relation to clutches in the automotive field. An elastic friction clutch can be positioned anywhere between the drum and the screw, especially between the differential-speed transmission and the hub of the screw. The vibrations affecting the screw as the result of the solids load are especially damaging to the transmission because sudden jolts must be accommodated subsequent to the appearance of such stress. The friction mechanism, which, as is the case with the other solutions, preferably parallels the elastic engagement, will extensively attenuate these vibrations as the amplitude increases and the frictional section lengthens.

To the extent that such vibrational malfunctions are transmitted from the solids and by way of the bowl to the machine bed as well, the aforesaid auxiliary attenuator will also come into force in the form of a disengaged fractional mass tuned to the critical natural frequency and will do so with increasing effectiveness the nearer the disruptive frequencies are within the range of critical natural frequencies of the remaining mass system.

Since the vibrations or impacts dictated by the solids between the screw and the bowl also include an axial component of force, the screw can also be axially supported at least elastically resilient, relieving or protecting the decanter's bearing from corresponding impact stress. An attenuating structure can of course also be interposed in this range of motion. The axial attenuation or resiliency can be provided between the screw and the drum in addition to that in course of the operational interconnection.

Finally, the component that is disengaged from the remaining mass system can also be designed variable in terms of its natural frequency in order specifically to initiate adaptation to whatever concrete maximum amplitude may occur in the course of controlling by automatically sensing the system's vibrations, its vibrational amplitude for example. The value obtained by sensing the amplitudes of vibration can for example be exploited to vary the rigidity of the resiliently supported interconnection between the disengaged mass and the rest of the system or the machine bed such that the natural frequency of the disengaged component matches the critical, always sensed, natural frequency of the rest of the system. This can be done for example with a hydraulic adjustment that by shortening the range of elasticity or the like affects the resilient characteristic of the installation interconnection between the disengaged component and the machine bed. A comparable situation can also be established in the elastic disengagement range between the screw and the drum in order to deal with vibrations that derive from the suspension.

These and other embodiments of the invention will be evident from the subsidiary claims, especially in conjunction with the examples illustrated in the drawing, and will now be described in explanation of the invention.

BRIEF DESCRIPTION OF THE DRAWINGS

FIG. 1 is a front and side view of the suspension of a motor on the wall of a diaphragm with a parallel attenuation mechanism, FIG. 2 is a front view of the decanter with the motor or its diaphragm wall next to it and mounted on one and the same machine bed, FIG. 3 illustrates a means of installing and securing the motor that differs from the one illustrated in FIG. 2.

DESCRIPTION OF THE PREFERRED EMBODIMENTS

Figure 4:
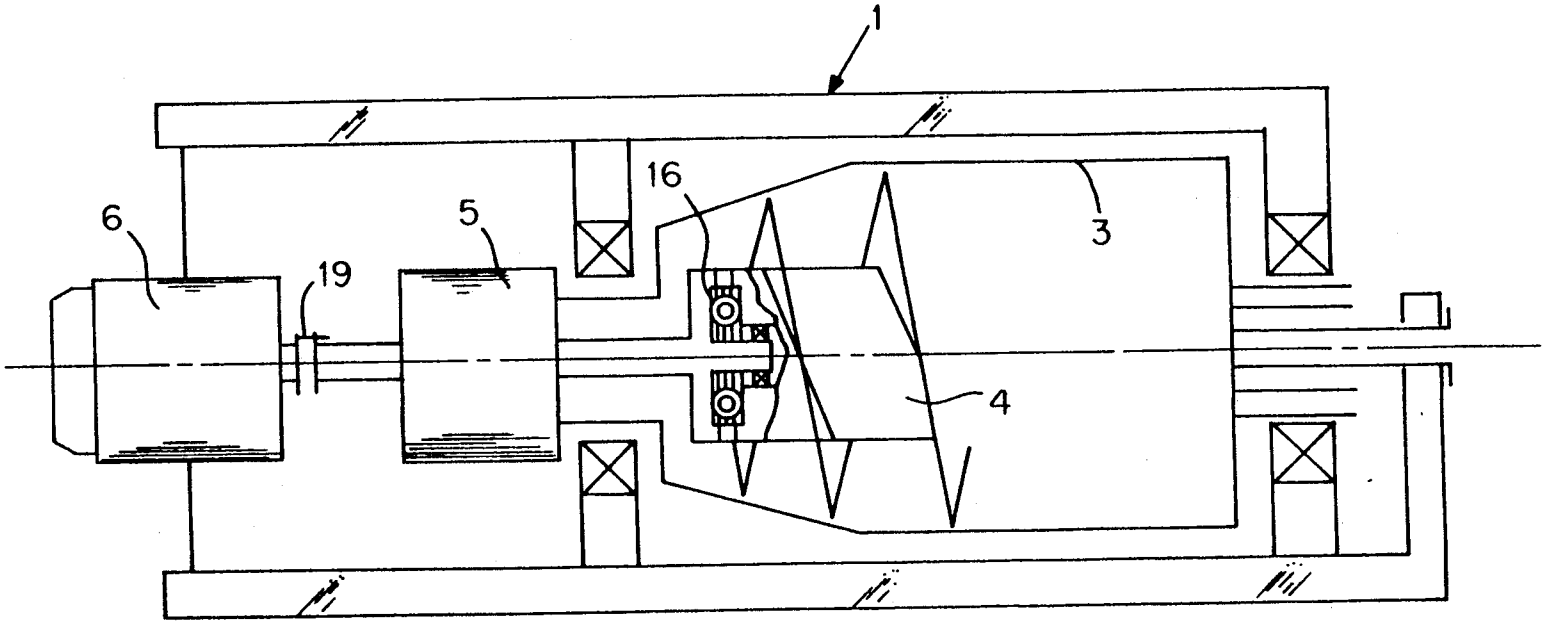
FIG. 4 is a schematic sectional view of a decanter with a screw that is attenuated and elastically positioned in relation to the drum in the path of operational interconnection.

FIG. 1 shows two views, rotated 90°, of essentially a mount 8 for a motor 6 that is positioned along with a centrifuge or decanter 2 (FIG. 2) on a single machine bed 1. As will be evident from FIGS. 4 and 5, the decanter's rotor 2 comprises a drum 3 and a screw 4 that are interconnected by way of a differential-speed transmission 5 such that screw 4 rotates, depending on whether it winds or the drum rotates to the left or to the right, moves more rapidly or more slowly than the drum in such a way that any solids that accumulate on the inner surface of the drum due to centrifugal force or rotation are conveyed away by the screw to an unillustrated extraction opening in the conical section of the drum. This type of decanter or solid-bowl screw-type centrifuge is known. The transmission 5 between screw 4 and drum 3 can operate with either a fixed or a variable ratio, to the extent that the motor is variable.

Figure 5:
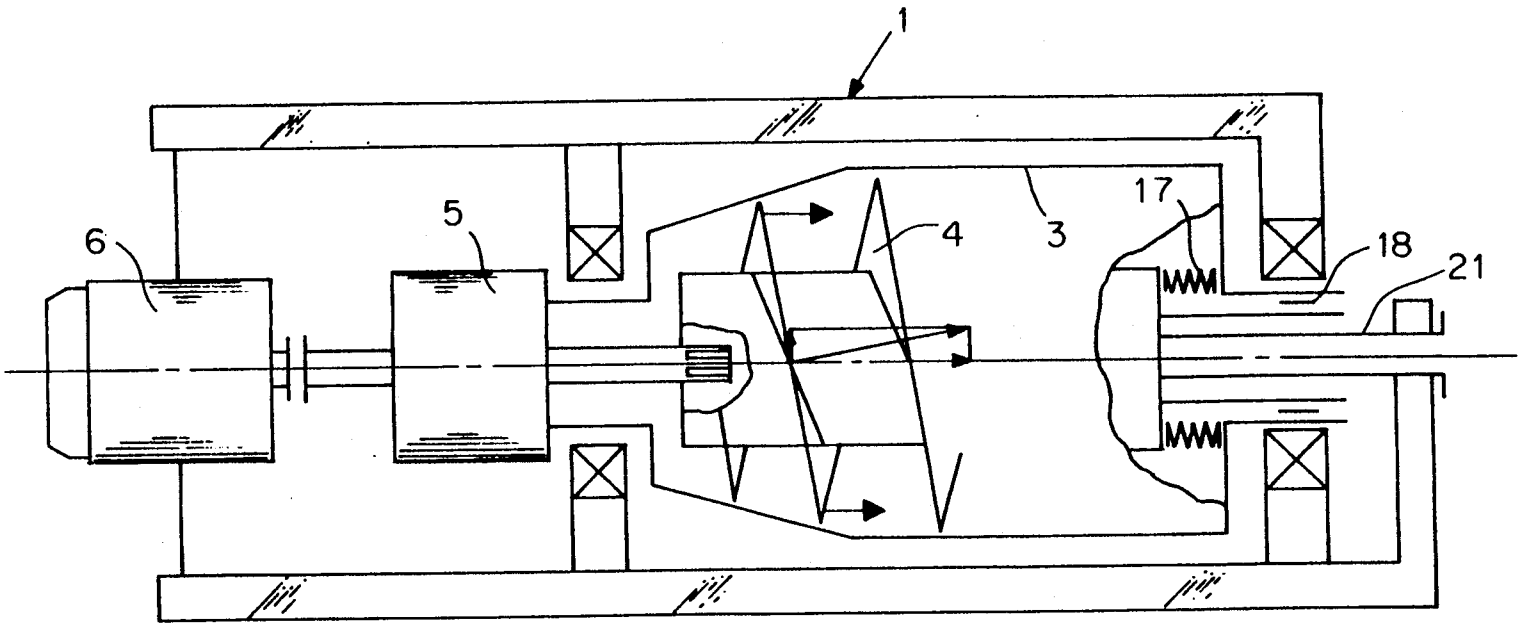
FIG. 5 is a schematic sectional view with a screw mounted such that it can be axially shifted in relation to the drum.

The motor 6 that drives the decanter illustrated in FIGS. 1 through 3, which can for example be attached, usually by way of the interposed transmission, directly to the drum or even to the screw, is designed to be what is called the disengaged mass fraction of the overall decanter system and consists of the illustrated drum 3, screw 4, and transmission 5, of unillustrated accessories, and of course of the motor 6, which is connected in FIGS. 2 and 3 by way of a belt drive 20 and is aligned with the axis of rotation of the decanter in FIGS. 4 and 5. The motor 6 in FIGS. 1 and 2 is secured to the center of a diaphragm wall 8 that is labeled "7" overall and is attached in an unillustrated way to machine bed 1. As will be especially evident from the left side of FIG. 1 and from FIG. 2, diaphragm wall 8 is provided with a large number of perforations 9 distributed more or less concentric around a centrally positioned zone 12 of attachment to which the motor is, as will be evident from FIG. 1, flanged. The perforations are interrupted circumferentially by bridges 10, resulting in correspondingly long webs 11 of material extending from zone 12 to the circumference by way of bridges 10. The purpose of this design is to lend rigidity to diaphragm wall 8 from zone 12 out in relation to machine bed 1 and in terms of transmitted torque, whereas zone 12 will yield in directions that have a component perpendicular to the plane of diaphragm wall 8. This applies to forces that are concretely coaxial with the axis of ritation of the decanter and to swaying motions around the center of zone 12 and paralleling the axis of rotation of the decanter. The intention is to make motor 6 "rigid" only with respect to the transmission of torque to the decanter and hence in relation to the other parts of the decanter but yielding in all other directions. This is particularly important when motor 6 is connected to decanter 2 by way of a belt drive 20 as illustrated in FIG. 2. Even in the coaxial position illustrated in FIGS. 4 and 5, however, wherein motor 6 is attached to transmission 5 or to drum 3 by way of a torque-transmission clutch 19, the motor can be mounted similarly.

The resulting elastic interconnection between motor 6 and machine bed 1 decreases the mass and elasticity of the overall decanter-mass system responsible for the critical natural frequency to the extent that some of the mass, specifically that of the motor, is extracted from the system. Depending on dimensions and operating behavior, such a means can by itself be sufficient to prevent critical natural frequencies in the operating range or to allow them to expend themselves uncritically.

The critical natural frequency will, however, often remain at least in the vicinity of the operating frequency and hence of the excitation of corresponding vibrations, so that in one especially preferred embodiment the disengaged component (and there can be several) can be designed in terms of its "installation frequency," its natural frequency in relation to the machine bed, that is, to ensure that the natural frequency will coincide with the critical natural frequency of the system of the remaining components. Because long vibration paths will occur when the critical natural frequency occurs more or less powerfully due to the excitation, and these motions can be correspondingly decreased, usually by converting them into heat of friction, by using attenuating mechanisms.

FIG. 3 illustrates one such example by way of a motor 6 that is supported on what are called rubber-to-metal connections, feet, that is, that yield in all directions, on the machine bed. To ensure that belt drive 20 is tight enough to transmit the requisite torque, the motor housing is to that extent non-elastically secured to machine bed 1 in the direction of belt tension by a connecting rod 15. Connecting rod 15 to that extent acts like diaphragm wall 8 with respect to rigidity in the direction of torque transmission. Motor 6 is secured to machine bed 1 by way of connections 14 with a natural vibration on the order of the critical natural frequency of the remaining mass system of the decanter. An attenuating mechanism 13 is more symbolically represented here in the form of a two-armed lever with T-screws that determine the friction between the arms. The system in FIG. 3 is not to be strictly interpreted as in the direction of the forces that are to be attenuated. It is, as has been said, more of a symbol. FIG. 1 on the other hand illustrates the position of the attenuating mechanism in relation to the vibrations that are to be attenuated more relevantly.

FIGS. 4 and 5 illustrate a spring-loaded and/or attenuated mount for securing screw 4 on drum 3, whereby the vibration phenomena that are to be accommodated by this means between the screw and the drum are dictated by the particular solids involved such that the screw tends, subject to friction, to decrease its differential speed in relation to the drum, and the associated forces are stored in transmission 5 until the latter, on account of its elasticity, discontinuously accelerates the screw against the drum. This also produces rhythmical operational malfunctions of a vibratory nature that considerably stress the mechanisms, especially the bearings of the rotating parts of the decanter. Due to the slope of the screw threads, the forces that trigger such vibrations between the drum and the screw are not only rotational but also translational along the axis of rotation, so that, as illustrated in FIG. 4, such vibratory phenomena can be accommodated by an attenuating mechanism 16, known from motor vehicles interposed in the transmission path between the screw and the drum or alternately or additionally by making the screw capable of resiliently shifting axially in relation to the drum, in FIG. 5 with an elastic axial support 17. This support can of course also operate in conjunction with an attenuating mechanism 18 as illustrated in FIG. 5.

By sensing the vibrations of the decanter, their amplitudes for instance, it becomes possible to determined critical natural frequencies, and the signals derived from such observations can be processed for controlling the natural frequency of whatever component or components are disengaged with the object of harmonizing their natural frequency to critical natural frequencies in the decanter-mass system in order to make long attenuation paths available. This can be done for example by controlling the spring characteristic of the suspension of each disengaged component, the motor 6 or screw 4 in the present example, especially by means of an appropriately positioned hydraulic mechanism that acts on the range and or hardness of the spring.

What is claimed is:

1. A decanter with an axis of rotation for separating a suspension into a solids phase and at least one liquid phase, comprising: a machine bed; a drum rotatable at a speed and resting on said bed; a screw rotatable inside said drum at a speed different from the speed of the drum; transmission means between said drum and said screw; torque-transmitting means; motor means with an axis of rotation resting on said bed and connected to said transmission means through said torque-transmitting means; intake and outlet lines communicating with said drum for conducting said solids phase and said liquid phase; an elastic bearing for disengaging at least one of said drum, screw, motor, and transmission means in at least one directino having a vector component parallel to the axis of rotation of said decanter; attenuating means, said elastic bearing engaging said drum, screw and transmission means through said attenuating means.

2. A decanter as defined in claim 1, wherein said elastic bearing for disengaging at least one of said drum, screw, motor, and transmission means in all directions as a vector component parallel to the axis of rotation of said decanter.

3. A decanter as defined in claim 1, wherein said motor is disengaged.

4. A decanter as defined in claim 3, including a diaphragm-formed wall secured to said motor and yielding perpendicular to a surface of said wall due to perforations distributed substantially concentrically around a zone whereat said wall is secured to said motor, said perforations being separated by bridging areas between said perforations, said perforations and said bridging areas being arranged to form substantially long bifurcated webs meandering radially outward from said zone.

5. A decanter as defined in claim 4, whereins aid torque-transmitting means comprises a belt drive having a tension secured by said diaphragm-formed wall.

6. A decanter as defined in claim 3, including flexible connections between said motor and said bed; and a brace connected to said motor for resisting forces resulting from transmitted torque.

7. A decanter as defined in claim 6, wherein said flexible connections comprise rubber-to-metal connections, said brace comprising a connecting rod pivotable between said motor and said bed, said motor being aligned with said axis of rotation of the decanter, said motor being substantially unelastically secured against rotation round the axis of said motor.

8. A decanter as defined in claim 1, wherein said elastic bearing is comprised of a synthetic material having a predetermined interior friction at operating temperatures.

9. A decanter as defined in claim 1, wherein said at least one of said drum, screw, motor, and transmission means is formed to match a critical natural frequency of the remaining decanter and is connected to said bed through said attentuating means, said attenuating means comprising friction-generating means.

10. A decanter as defined in claim 1, including a torsionally elastic clutch having friction-generating damping means and being connected between said screw and said drum.

11. A decanter as defined in claim 10, wherein said screw can travel axially back and forth elastically relative to said drum due to friction generated by said damping means.

12. A decanter with an axis of rotation for separating a suspension into a solids phase and at least one liquid phase, comprising: a machine bed, a drum rotatable at a speed and resting on said bed; a screw rotatable inside said drum at a speed different from the speed of the drum; transmission means between said drum and said screw; torque-transmitting means; motor means with an axis of rotation resting on said bed and connected to said drum and screw through said torque-transmitting means; intake and outlet lines communicating with said drum for conducting said solids phase and said liquid phase; an elastic bearing for disengaging at least one of said drum, screw, motor, and transmission means in at least one direction having a vector component parallel to the axis of rotation of said decanter; attenuating means, said elastic bearing engaging said drum, screw and transmission means through said attenuating means.

* * * * *